US009909388B2

(12) United States Patent
Webber

(10) Patent No.: US 9,909,388 B2
(45) Date of Patent: Mar. 6, 2018

(54) PRESSURE INDEXING SLIDING SIDE DOOR WITH RAPID ACTUATION

(71) Applicant: HALLIBURTON ENERGY SERVICES, INC., Houston, TX (US)

(72) Inventor: Andrew J. Webber, Cypress, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 311 days.

(21) Appl. No.: 14/420,406

(22) PCT Filed: Dec. 27, 2012

(86) PCT No.: PCT/US2012/071860
§ 371 (c)(1),
(2) Date: Feb. 9, 2015

(87) PCT Pub. No.: WO2014/105026
PCT Pub. Date: Jul. 3, 2014

(65) Prior Publication Data

US 2015/0218908 A1 Aug. 6, 2015

(51) Int. Cl.
*E21B 34/10* (2006.01)
*E21B 34/14* (2006.01)
*E21B 34/00* (2006.01)

(52) U.S. Cl.
CPC ..... *E21B 34/10* (2013.01); *E21B 2034/007* (2013.01)

(58) Field of Classification Search
CPC ..... E21B 34/10; E21B 34/102; E21B 34/12
(Continued)

(56) References Cited

U.S. PATENT DOCUMENTS 3,889,751 A 6/1975 Peters
4,058,165 A 11/1977 Holden et al.
(Continued)

FOREIGN PATENT DOCUMENTS

WO 9747850 A1 12/1997
WO 2004033849 A1 4/2004
WO 2009009281 A2 1/2009

OTHER PUBLICATIONS

Halliburton; "LA0 Liquid Spring-Actuated Anvil Plugging System", Packers Article 6-68-6-69, received Mar. 13, 2015, 2 pages.
(Continued)

*Primary Examiner* — Kenneth L Thompson
(74) *Attorney, Agent, or Firm* — Locke Lord LLP; Joshua L. Jones

(57) ABSTRACT

A valve can include a closure device which selectively permits and prevents fluid communication between an interior and an exterior of the valve, an incremental displacement device which incrementally displaces the closure device in response to pressure differentials between the interior and the exterior of the valve, and an accelerator device which accelerates displacement of the closure device in response to a predetermined pattern of the pressure differentials. A method of operating a valve in a well can include applying a predetermined pattern of pressure differentials between an interior and an exterior of a tubular string in which the valve is connected, thereby incrementally displacing a closure device of the valve, and accelerating displacement of the closure device in response to the predetermined pattern of pressure differentials, thereby displacing the closure device to a selected one of an open and a closed position.

18 Claims, 6 Drawing Sheets

(58) Field of Classification Search
USPC ..... 166/321, 320, 334.4
See application file for complete search history.

(56) References Cited

U.S. PATENT DOCUMENTS

| | | | | |
|---|---|---|---|---|
| 4,448,254 | A | 5/1984 | Barrington | |
| 4,474,242 | A * | 10/1984 | Upchurch | E21B 49/001 166/323 |
| 4,566,478 | A * | 1/1986 | Deaton | E21B 21/10 137/112 |
| 5,343,949 | A | 9/1994 | Ross et al. | |
| 5,597,042 | A | 1/1997 | Tubel et al. | |
| 5,609,178 | A | 3/1997 | Henning et al. | |
| 5,826,661 | A | 10/1998 | Parker et al. | |
| 6,276,458 | B1 | 8/2001 | Malone et al. | |
| 6,397,949 | B1 | 6/2002 | Walker et al. | |
| 6,659,186 | B2 | 12/2003 | Patel | |
| 6,668,936 | B2 | 12/2003 | Williamson, Jr. et al. | |
| 6,820,697 | B1 | 11/2004 | Churchill | |
| 7,594,542 | B2 * | 9/2009 | Loretz | E21B 34/10 166/320 |
| 7,870,908 | B2 | 1/2011 | Mandrou | |
| 8,061,431 | B2 | 11/2011 | Moore et al. | |
| 8,186,439 | B2 * | 5/2012 | Lauderdale | E21B 23/006 166/331 |
| 2008/0001111 | A1 | 1/2008 | Ross | |
| 2010/0051289 | A1 | 3/2010 | Constantine et al. | |
| 2016/0123113 | A1 * | 5/2016 | Allen | E21B 34/10 166/308.1 |

OTHER PUBLICATIONS

Halliburton; "FS Fluid Loss Isolation Barrier Valve", H07007, dated Nov. 2013, 2 pages.

Halliburton; "Isolation Barrier Valves", H07542, dated Jun. 2010, 4 pages.

International Search Report with Written Opinion issued Sep. 2, 2013 for PCT Patent Application No. PCT/US12/071860, 15 pages.

* cited by examiner

PRESSURE INDEXING SLIDING SIDE DOOR WITH RAPID ACTUATION

TECHNICAL FIELD

This disclosure relates generally to equipment utilized and operations performed in conjunction with a subterranean well and, in one example described below, more particularly provides a pressure indexing sliding side door with rapid actuation.

BACKGROUND

It is known to operate sliding side doors in wells by applying a predetermined number and/or pattern of pressure manipulations interior to and/or exterior to a tubular string. However, relatively simple and reliable incremental axial displacement ratchet devices would not be used for opening or closing sliding side doors, since a very large number of pressure manipulations would be required to displace a sliding sleeve between its open and closed positions.

Therefore, it will be appreciated that improvements are needed in the art of constructing and operating sliding side doors in wells.

DETAILED DESCRIPTION

Figure 1:
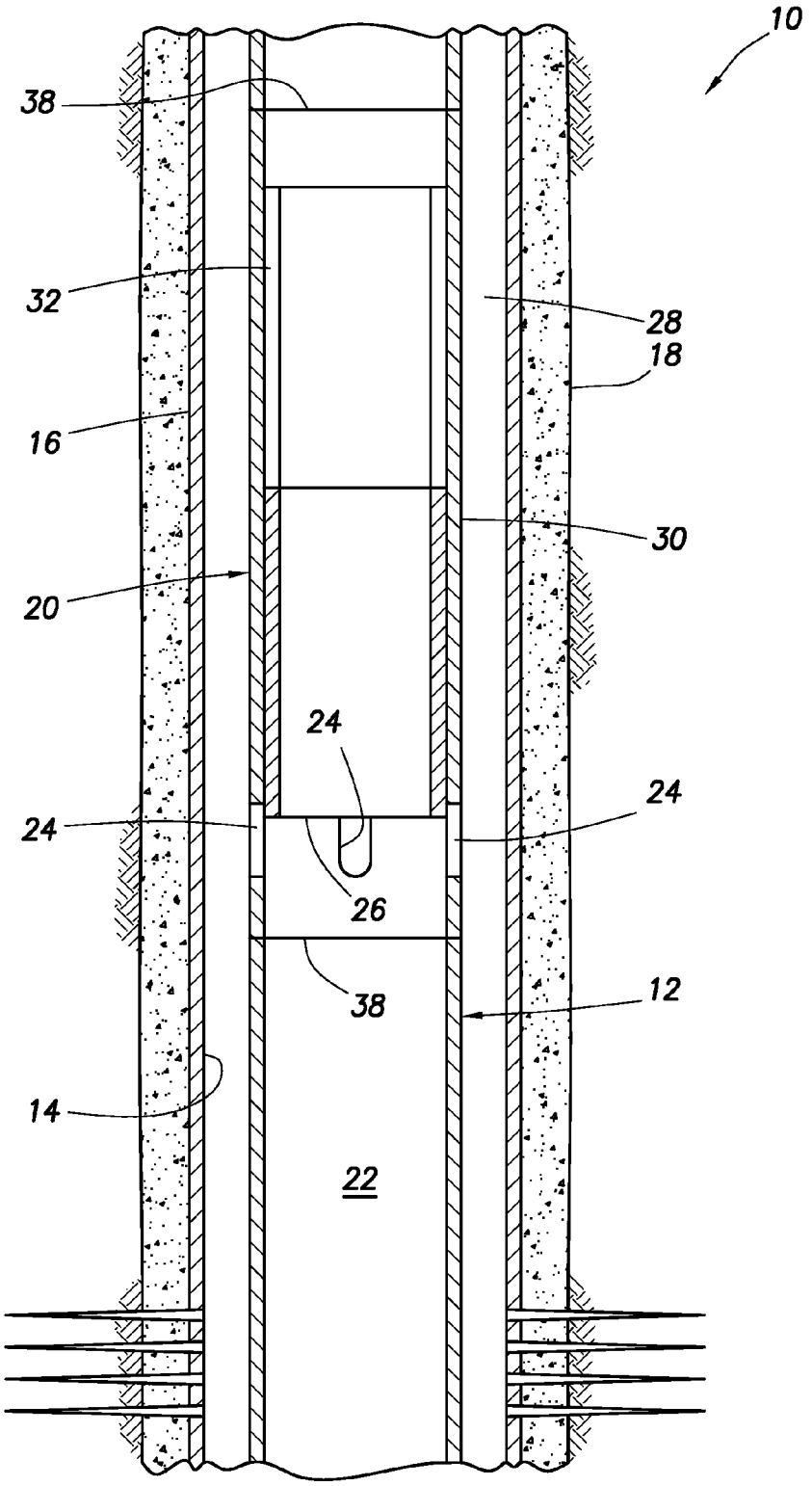
FIG. 1 is a representative partially cross-sectional view of a well system and associated method which can embody principles of this disclosure.

Representatively illustrated in FIG. 1 is a system 10 for use with a subterranean well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14 lined with casing 16 and cement 18. In other examples, the wellbore 14 could be uncased or open hole.

A valve 20 is connected in the tubular string 12, so that a longitudinal flow passage 22 extending through the tubular string also extends through the valve. The valve 20 includes openings 24 and a closure device 26 which selectively blocks flow through the openings, so that fluid communication is selectively permitting and prevented between the flow passage 22 in an interior of the valve, and an annulus 28 on an exterior of the valve.

The closure device 26 in the FIG. 1 example comprises an axially displaceable sleeve, and the openings 24 are formed in a generally tubular housing 30, and so the valve 20 is of the type known to those skilled in the art as a sliding sleeve valve or sliding side door. However, other types of valves (e.g., ball valves, plug valves, etc.) can benefit from the principles described herein.

The valve 20 in the FIG. 1 example, however, includes an actuator 32 which incrementally displaces the closure device 26 in response to pressure differentials applied between the flow passage 22 and the annulus 28. When a predetermined pattern (number, sequence, etc.) of pressure differentials have been applied, the actuator 32 accelerates the closure device 26 to a desired open or closed position. In this manner, the closure device 26 does not have to be incrementally displaced all the way to the desired position (which could take a large number of incremental displacements).

Figure 2:
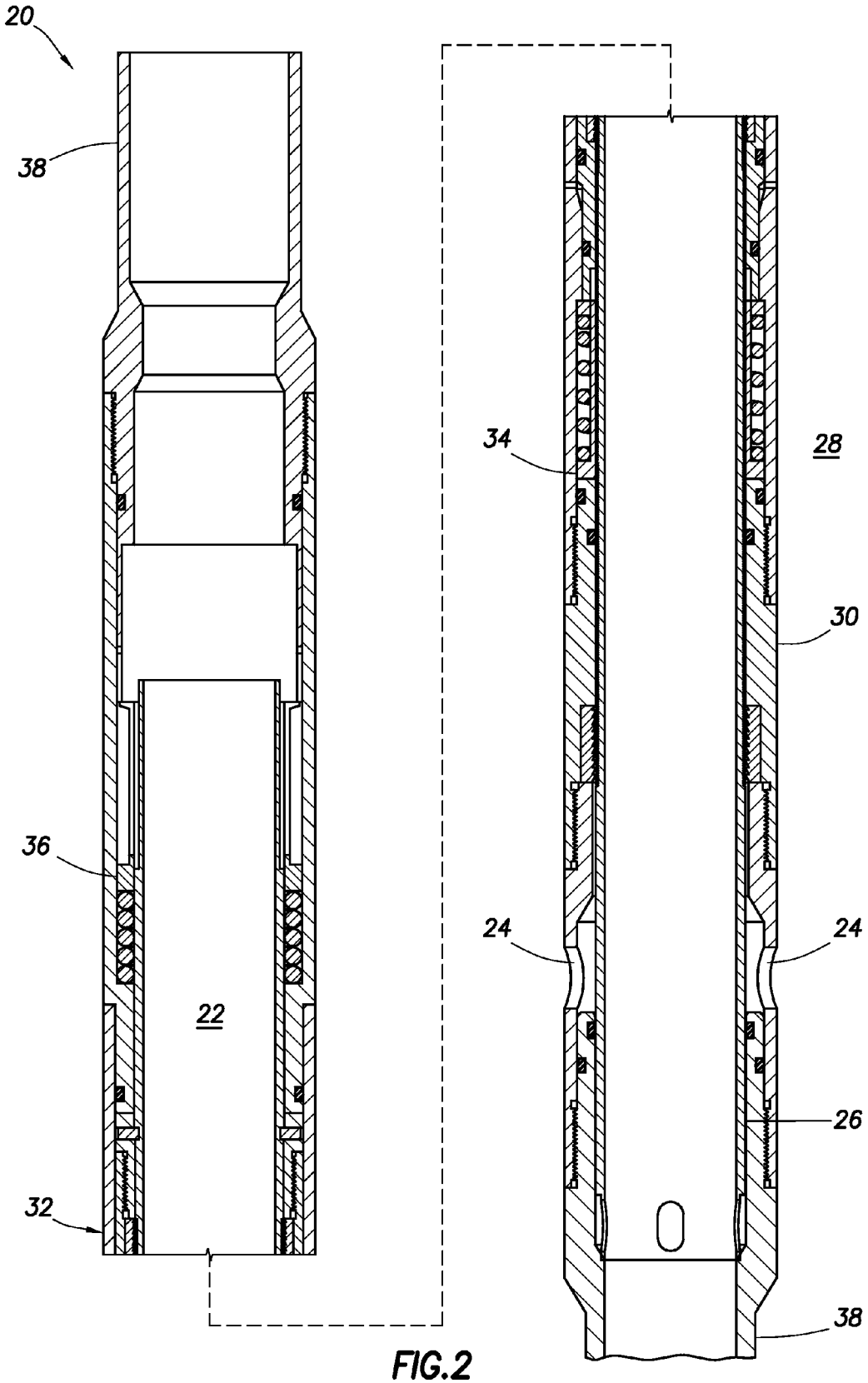
FIG. 2 is a representative cross-sectional view of a valve which can embody the principles of this disclosure.

Referring additionally now to FIG. 2, a cross-sectional view of an example of the valve 20 is representatively illustrated. In this view, it may be seen that the actuator 32 of the valve 20 includes an incremental displacement device 34 and an accelerator device 36.

The valve 20 is provided with tubular string connections 38 for connecting the valve in the tubular string 12. However, it should be understood that the valve 20 could be connected in other tubular strings and could be used in other systems and methods, in keeping with the scope of this disclosure.

The incremental displacement device 26 incrementally axially displaces the closure device 26 toward an open position in which fluid communication is permitted between the interior and the exterior of the valve 20. In the open position, the closure device 26 does not block flow through the openings 24, so that the flow passage 22 is in communication with the annulus 28.

The accelerator device 36 accelerates the displacement of the closure device 26 axially to the open position when a predetermined pattern of pressure differentials have been applied between the flow passage 22 and the annulus 28. Thus, the incremental displacement device does not displace the closure device 26 all the way to its open position.

Figure 3:
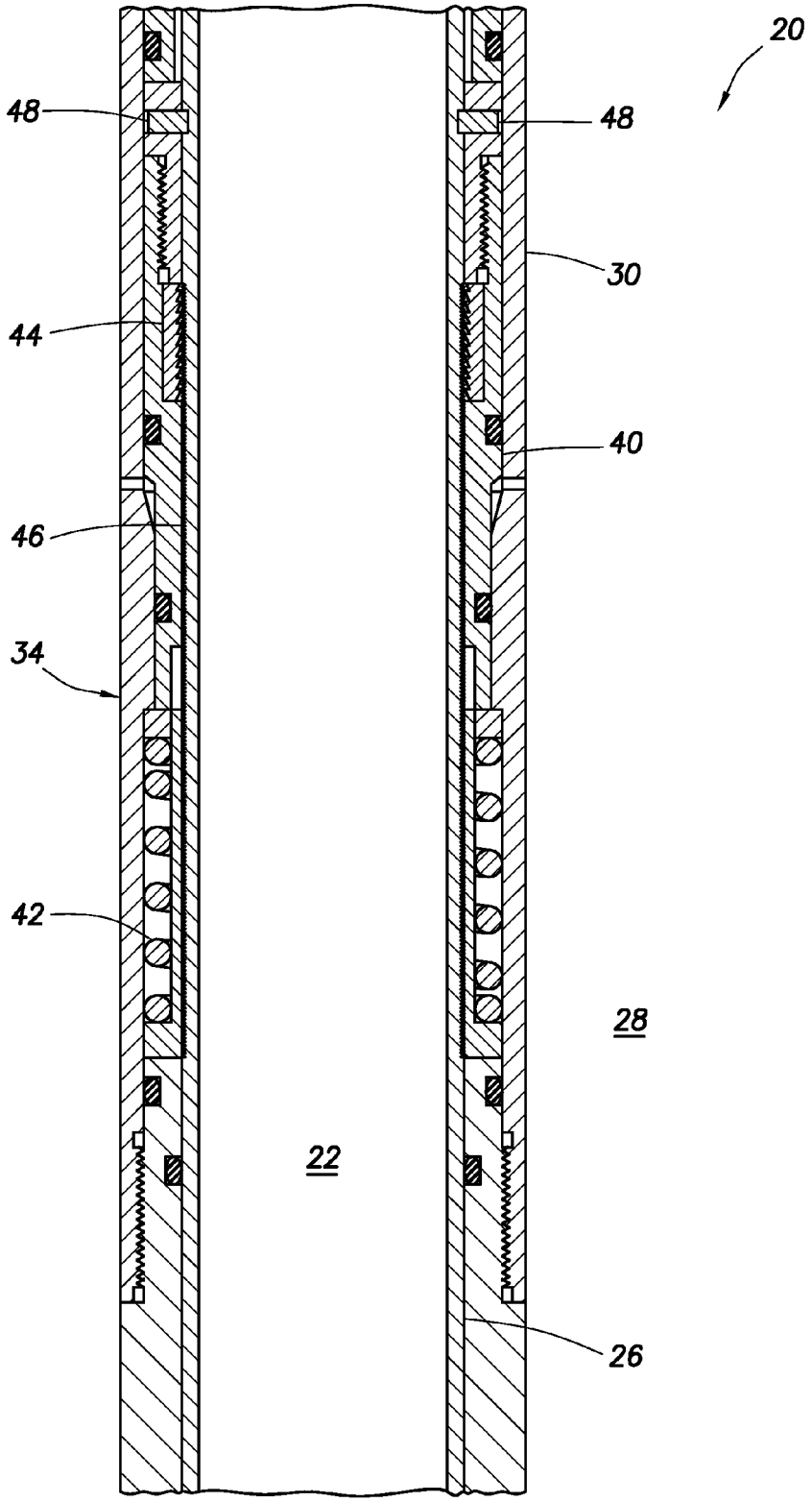
FIG. 3 is a representative cross-sectional view of an incremental displacement device of the valve.

Referring additionally now to FIG. 3, an enlarged scale cross-sectional view of the incremental displacement device 34 is representatively illustrated. In this view, it may be seen that the increment displacement device 34 includes an annular piston 40 which is downwardly biased by a pressure differential from an interior of the valve 20 to an exterior of the valve.

In the FIG. 3 example, the piston 40 is biased upwardly by a biasing device 42, such as, a coiled compression spring. However, other types of biasing devices (for example, compressed gas chambers, liquid springs, extension springs, etc.) may be used in other examples.

A gripping device 44 displaces with the piston 40 and grips an outer serrated or toothed tubular surface 46 of the closure device 26. In this example, the gripping device 44 allows upward displacement of the closure device 26 toward its open position, but the gripping engagement between the gripping device and the surface 46 prevents downward displacement of the closure device relative to the piston 40.

The gripping device 44 is depicted in FIG. 3 as being a generally tubular sleeve which is internally circumferentially toothed, and is biased by its own elasticity into gripping contact with the surface 46. However, other types of gripping devices (for example, gripping wedges, spring-biased teeth, etc.) may be used in other examples.

Shear members 48 releasably retain the piston 40 against displacement relative to the closure device 26. When a predetermined level of pressure differential from the passage 22 to the annulus 28 is applied, the shear members 48 will shear and allow the piston 40 to displace downwardly against a biasing force exerted upwardly by the biasing device 42.

When the pressure differential from the passage 22 to the annulus 28 is sufficiently reduced, the biasing device 42 will displace the piston 40 upwardly, and the closure device 26 will be displaced upwardly with the piston (the gripping device 44 preventing the piston from displacing upwardly without the closure device). The piston 40 can then be displaced downwardly by increasing the pressure differential from the passage 22 to the annulus 28.

The gripping device 44 allows such downward displacement of the piston 40 relative to the closure device 26. Another gripping device 62 (see FIG. 6) prevents the closure device 26 from displacing downwardly with the piston 40, but permits upward displacement of the closure device with the piston.

In this manner, the closure device 26 is incrementally displaced axially upward in response to repeated applications of increased and decreased pressure differentials from the passage 22 to the annulus 28. However, it is not desired in this example for the incremental displacement device 34 to be used to displace the closure device 26 all the way to its open position. Instead, it is desired that the incremental displacement device 34 displace the closure device 26 to a position in which the accelerator device 36 will more rapidly displace the closure device to its open position.

Figure 4:
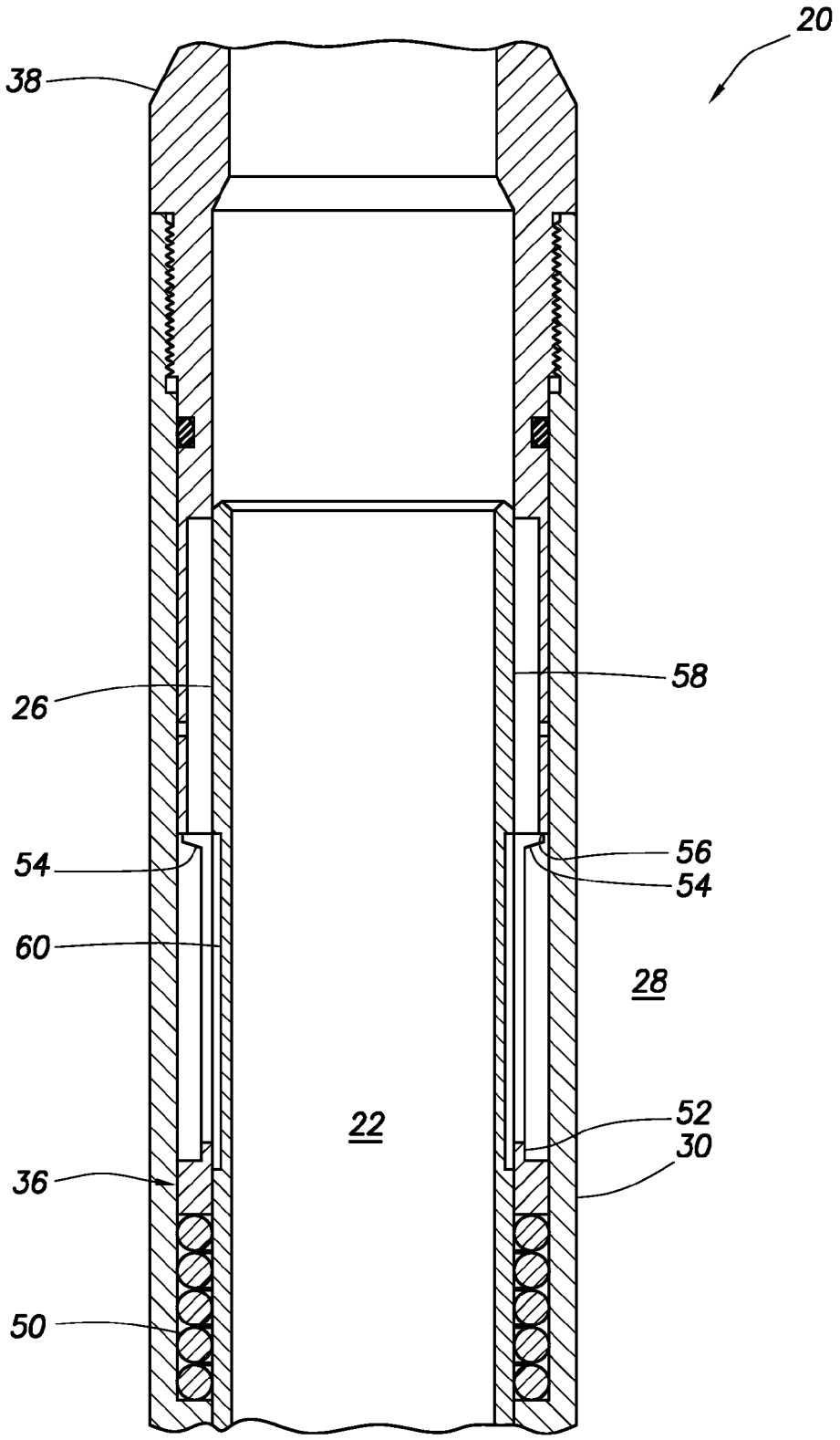
FIG. 4 is a representative cross-sectional view of an accelerator device of the valve.

Referring additionally now to FIG. 4, a cross-sectional view of the accelerator device 36 is representatively illustrated. In this view, it may be seen that the accelerator 36 includes a biasing device 50 and a sleeve 52 having radially flexible collet fingers 54 formed in an upper end thereof.

The biasing device 50 biases the sleeve 52 upward, but the sleeve is prevented from displacing upward by engagement between the collet fingers 54 and a shoulder 56 in the housing 30. The collet fingers 54 are initially supported radially outward into engagement with the shoulder 56 by an outer surface 58 on the closure device 26.

However, when a predetermined number of incremental displacements of the closure device 26 upward with the piston 40 have been performed as described above, a radially reduced recess 60 on the closure device 26 will underlie the collet fingers 54. As a result, the surface 58 will no longer radially support the collet fingers 54 in engagement with the shoulder 56, and the biasing device 50 can displace the sleeve 52 upward.

When the collet fingers 56 engage the recess 60, they cause the closure device 26 to be upwardly displaced with the sleeve 52. A force applied to the closure device 26 from the biasing device 50 accelerates the closure device axially upward to its open position. In this manner, incremental displacements are not used to displace the closure device 26 all the way to its open position.

Figure 5:
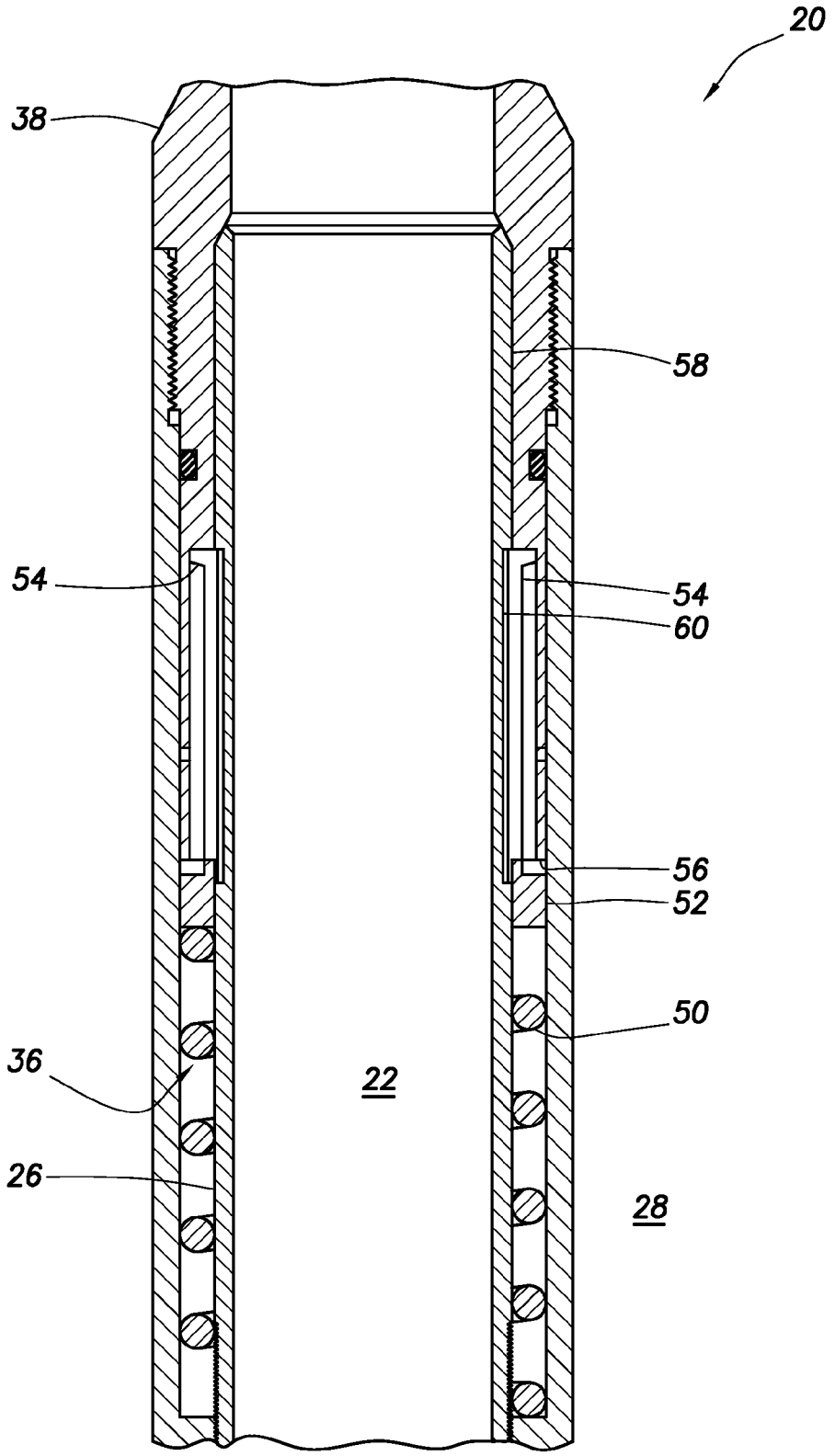
FIG. 5 is a representative cross-sectional view of the accelerator device after actuation of the valve.

Referring additionally now to FIG. 5, the valve 20 is representatively illustrated with the closure device 26 displaced upwardly to its open position. Note that the collet fingers 54 are engaged with the recess 60, so that the biasing device 50 biases the closure device 26 upward with the sleeve 52.

Figure 6:
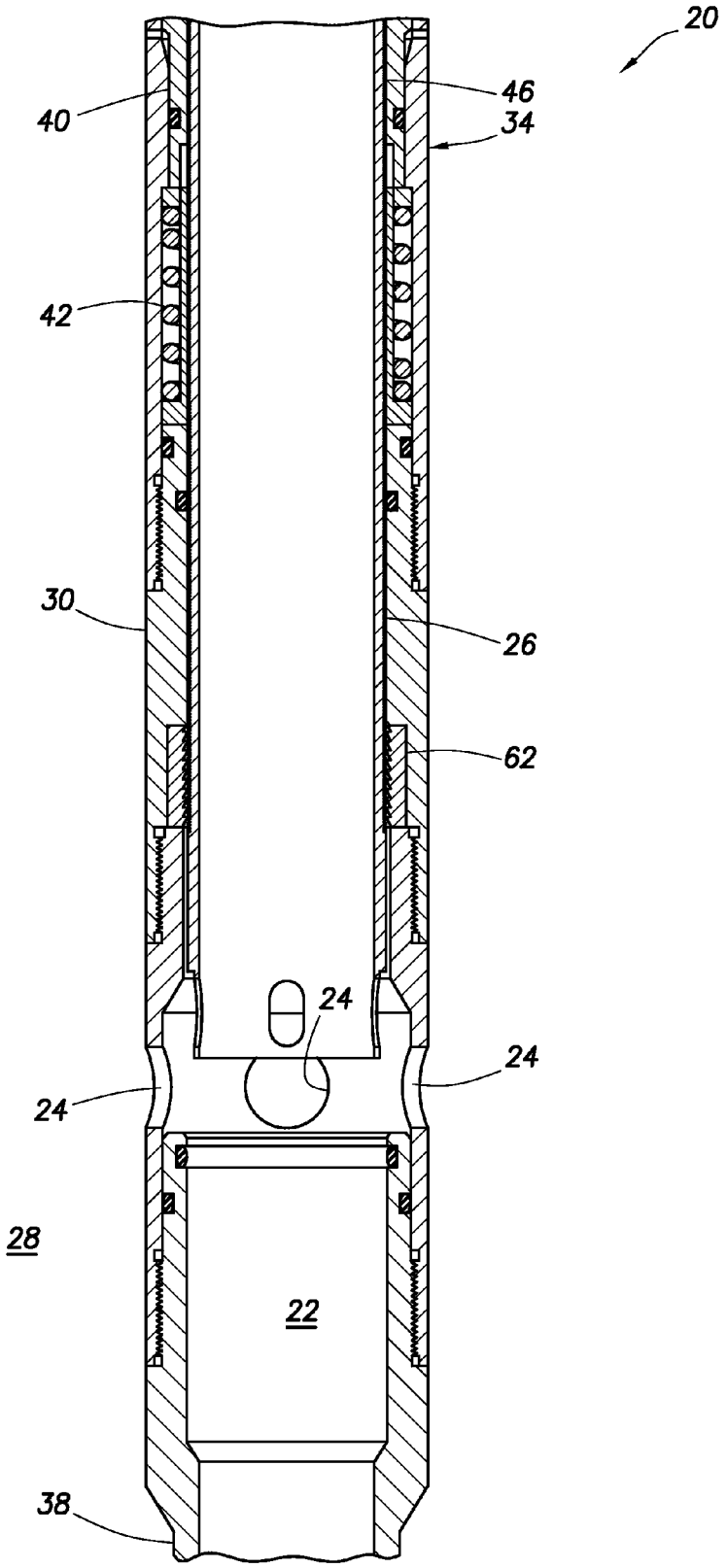
FIG. 6 is a representative cross-sectional view of the valve after actuation.

Referring additionally now to FIG. 6, the closure device 26 is depicted in its open position. The closure device 26 no longer blocks flow through the openings 24, and fluid communication is now permitted between the interior passage 22 and the exterior annulus 28.

It may now be fully appreciated that the above disclosure provides significant advancements to the arts of constructing and operating valves in wells. The valve 20 described above can be opened by applying a predetermined level of a pressure differential from the passage 22 to the annulus 28 to shear the shear members 48, and then the valve can be opened by applying a predetermined pattern of pressure differentials.

A subterranean well valve 20 is provided to the art by the above disclosure. In one example, the valve 20 can include a closure device 26 which selectively permits and prevents fluid communication between an interior and an exterior of the valve 20, an incremental displacement device 34 which incrementally displaces the closure device 26 in response to pressure differentials between the interior and the exterior of the valve 20, and an accelerator device 36 which accelerates displacement of the closure device 26 in response to a predetermined pattern of the pressure differentials.

The valve 20 may include tubular string connectors 38 at opposite ends thereof, whereby the valve 20 is configured for controlling flow between an interior and an exterior of a tubular string 12.

The incremental displacement device 34 may axially displace the closure device 26. The accelerator device 36 may axially displace the closure device 26. In other examples, the closure device 26 could be rotationally displaced, helically displaced, etc.

The accelerator device 36 can comprise at least one biasing device 50 which applies a force to the closure device 26 in response to the predetermined pattern of pressure differentials.

The accelerator device 36 may displace the closure device 26 to an open or closed position.

The incremental displacement device 34 may comprise a gripping sleeve (such as gripping devices 44, 62) which permits incremental axial displacement of the closure device 26 in a first direction, but which prevents axial displacement of the closure device 26 in an opposite second direction, in response to the pressure differentials.

The incremental displacement device 34 may displace the closure device toward an open position in which fluid communication is permitted between an interior and an exterior of the valve 20. The accelerator device 36 may displace the closure device 26 to an open position in which fluid communication is permitted between the interior and the exterior of the valve 20.

A method of operating a valve 20 in a well is also provided to the art by the above disclosure. In one example, the method can comprise: applying a predetermined pattern of pressure differentials between an interior and an exterior of a tubular string 12 in which the valve 20 is connected, thereby displacing a closure device 26 of the valve 20; and accelerating displacement of the closure device 26 in response to the predetermined pattern of pressure differentials, thereby displacing the closure device 26 to a selected one of an open and a closed position.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used.

Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A subterranean well valve, comprising:

a closure device which selectively permits and prevents fluid communication between an interior and an exterior of the valve;

an incremental displacement device which incrementally displaces the closure device in response to pressure differentials between the interior and the exterior of the valve; and an accelerator device which accelerates displacement of the closure device in response to a predetermined pattern of the pressure differentials, wherein the incremental displacement device comprises a gripping sleeve which permits incremental axial displacement of the closure device in a first direction, but which prevents axial displacement of the closure device in an opposite second direction, in response to the pressure differentials.

2. The valve of claim 1, wherein the valve includes tubular string connectors at opposite ends thereof, whereby the valve is configured for controlling flow between an interior and an exterior of a tubular string.

3. The valve of claim 1, wherein the incremental displacement device axially displaces the closure device.

4. The valve of claim 1, wherein the accelerator device axially displaces the closure device.

5. The valve of claim 1, wherein the accelerator device comprises at least one biasing device which applies a force to the closure device in response to the predetermined pattern of pressure differentials.

6. The valve of claim 1, wherein the accelerator device displaces the closure device to a closed position.

7. The valve of claim 1, wherein the accelerator device displaces the closure device to an open position.

8. The valve of claim 1, wherein the incremental displacement device displaces the closure device toward an open position in which fluid communication is permitted between the interior and the exterior of the valve.

9. The valve of claim 1, wherein the accelerator device displaces the closure device to an open position in which fluid communication is permitted between the interior and the exterior of the valve.

10. A method of operating a valve in a well, the method comprising:

applying a predetermined pattern of pressure differentials between an interior and an exterior of a tubular string in which the valve is connected, thereby incrementally displacing a closure device of the valve; and accelerating displacement of the closure device in response to the predetermined pattern of pressure differentials, thereby displacing the closure device to a selected one of an open and a closed position, wherein the applying comprises a gripping sleeve permitting incremental axial displacement of the closure device in a first direction, but preventing axial displacement of the closure device in an opposite second direction, in response to the pressure differentials.

11. The method of claim 10, further comprising connecting the valve in the tubular string, whereby the valve controls flow between the interior and the exterior of the tubular string.

12. The method of claim 10, wherein the applying comprises an incremental displacement device axially displacing the closure device.

13. The method of claim 10, wherein the accelerating comprises an accelerator device axially displacing the closure device.

14. The method of claim 13, wherein the accelerator device comprises at least one biasing device which applies a force to the closure device in response to the predetermined pattern of pressure differentials.

15. The method of claim 10, wherein the accelerating comprises displacing the closure device to a closed position.

16. The method of claim 10, wherein the accelerating comprises displacing the closure device to an open position.

17. The method of claim 10, wherein the applying further comprises displacing the closure device toward an open position in which fluid communication is permitted between the interior and the exterior of the valve.

18. The method of claim 10, wherein the accelerating further comprises displacing the closure device to an open position in which fluid communication is permitted between the interior and the exterior of the valve.

* * * * *